US006786375B2

(12) United States Patent
Worden et al.

(10) Patent No.: US 6,786,375 B2
(45) Date of Patent: Sep. 7, 2004

(54) FOOTWEAR PACK

(76) Inventors: Eli Worden, 165 Bennett Ave. Apt. 1J, New York, NY (US) 10040; Virginia Annibale, 165 Bennett Ave. Apt. B, New York, NY (US) 10040

( * ) Notice: Subject to any disclaimer, the term of this patent is extended or adjusted under 35 U.S.C. 154(b) by 48 days.

(21) Appl. No.: 10/161,385

(22) Filed: Jun. 3, 2002

(65) Prior Publication Data

US 2002/0179664 A1 Dec. 5, 2002

Related U.S. Application Data

(60) Provisional application No. 60/295,684, filed on Jun. 4, 2001.

(51) Int. Cl.[7] ..... A45F 5/10

(52) U.S. Cl. ..... 224/627; 224/628; 224/643; 224/650; 224/652; 224/653; 224/656; 206/315.1

(58) Field of Search ..... 224/581–583, 224/627, 628, 907, 643, 637, 650–653, 656–658; 206/315.1; D3/217, 226, 317; 294/159, 160, 141, 162, 165; 383/38, 41, 61.4, 72, 75

(56) References Cited

U.S. PATENT DOCUMENTS

| | | | | | |
|---|---|---|---|---|---|
| 2,276,765 | A | * | 3/1942 | De Gree | 383/41 |
| 2,497,325 | A | * | 2/1950 | Scherba | 383/41 |
| D159,471 | S | * | 8/1950 | Chour | 206/315.1 |
| 3,209,870 | A | * | 10/1965 | Johns | 294/159 |
| 4,126,256 | A | * | 11/1978 | McGruder | 383/38 |
| 4,160,301 | A | | 7/1979 | Woolley | 12/120.5 |
| 4,739,913 | A | * | 4/1988 | Moore | 224/643 |
| 4,779,362 | A | | 10/1988 | Citrowski | 36/132 |
| 4,867,359 | A | | 9/1989 | Donovan | 224/202 |
| 5,269,580 | A | | 12/1993 | Hsiao | 194/162 |
| 5,439,153 | A | * | 8/1995 | Murdoch et al. | 224/658 |
| 5,456,353 | A | * | 10/1995 | Challoner et al. | 206/315.1 |
| D367,173 | S | * | 2/1996 | Trihus | D3/217 |
| 5,509,589 | A | | 4/1996 | Kliot | 224/209 |
| 5,564,539 | A | | 10/1996 | Duesing | 190/107 |
| 5,603,545 | A | | 2/1997 | Benson et al. | 294/150 |
| 5,611,427 | A | | 3/1997 | Bigham | 206/315 |
| 5,651,486 | A | | 7/1997 | Kliot | 224/653 |
| D382,110 | S | * | 8/1997 | Pollari | D3/217 |
| 5,788,305 | A | | 8/1998 | Hung | 294/160 |
| 5,826,771 | A | | 10/1998 | Peng | 224/651 |
| 5,881,708 | A | | 3/1999 | Kliot | 224/653 |
| D408,138 | S | * | 4/1999 | Mracna | D3/261 |
| D417,072 | S | * | 11/1999 | Reinhart | D3/226 |
| 6,126,054 | A | * | 10/2000 | Riemer | 383/41 |
| 6,315,178 | B1 | * | 11/2001 | Nobata | 224/627 |

FOREIGN PATENT DOCUMENTS

| | | | |
|---|---|---|---|
| DE | 29819834 | * | 2/1999 |

* cited by examiner

*Primary Examiner*—Nathan J. Newhouse
(74) *Attorney, Agent, or Firm*—Gifford, Krass, Groh, Sprinkle, Anderson & Citkowski, P.C.

(57) ABSTRACT

A pack provides a lightweight compact carrier for bulky footwear such as inline skates, ice skates or a skateboard. The pack includes a skate blade compartment with two adjustably sized openings, each opening adapted to receive a skate blade. A securing element retains the skate blade within each of the openings. A carrying strap is affixed to the skate blade compartment.

21 Claims, 13 Drawing Sheets

FOOTWEAR PACK

RELATED APPLICATION

The present application claims priority of U.S. Provisional Patent Application No. 60/295,684 filed Jun. 4, 2001, which is incorporated herein by reference.

FIELD OF THE INVENTION

The present invention relates in general to a backpack and in particular to a backpack adapted for footwear transport.

BACKGROUND OF THE INVENTION

Many sports require specialized footwear which is often bulky, unwieldy and difficult to carry. Such specialized footwear is often not adapted to wearing in the course of usual daily activities, adding the additional complication that the user must wear street shoes in transit to the site of the sports activity and awkwardly carry the specialized sports footwear. Thereafter, the user exchanges the street shoes for the specialized footwear and either must find street shoes storage or carry shoes while engaged in a sports activity.

SUMMARY OF THE INVENTION

An inventive pack includes a skate blade compartment having an adjustable size opening adapted to receive a skate blade and a second adjustable opening also adapted to receive a skate blade. A skate blade is maintained in contact with an opening by way of a securing element. A carrying strap is affixed to the skate blade compartment. A skate blade extends generally parallel to an opening with the two skates in opposition. A skate blade compartment has an extension generally parallel to the first opening to form a skate blade brake receiving section. Preferably, a pair of straps are spaced along the skate blade compartment and adapted to engage the shoulders of a user.

In another embodiment, a pack includes a first skate blade compartment having an opening adapted to receive a skate blade. A securement element proximal to the opening maintains the opening in contact with the skate blade. A strap is included that is adapted to circumvent a user thigh and support the pack against the user thigh. A second like pack or mirror image pack is provided to secure a second skate blade of a pair against a user thigh for transport.

DETAILED DESCRIPTION OF THE PREFERRED EMBODIMENTS

The pack of the present invention provides a lightweight, compact carrier for bulky, unwieldy footwear such as inline skates, ice skates or a skateboard. In addition, the pack provides a convenient carrier for street footwear while engaged in sports activities. For example, a person may skate and use the pack to carry street footwear and personal belongings such as money, keys, food and beverages. This frees the user to skate without having to return to the point of origin to retrieve stored shoes or other items.

The present invention provides a light compact carrier with a skate blade compartment for carrying unwieldy footwear. A carrier is also provided with shoe covers for carrying other footwear such as street shoes. Preferably, the shoe covers are in opposition. A sack is also provided for carrying other items such as skate accessories, wrist guards, kneepads and personal items such as money, keys, food and beverages. A rain cover to protect footwear from rain, snow and mud is also optionally provided.

While the present invention is detailed herein with respect to a backpack embodiment, it is appreciated a skate carrier adapted to carry other footwear is readily utilized as a hip pack through the replacement of shoulder straps with a primary waist belt or as a sling through the replacement of shoulder straps with a single strap. It is contemplated that the single strap is optionally detachable and the inventive pack is carried by way of a handle or attached to other articles of baggage. Alternatively a skate carrier has two separate components each adapted to mount to a wearer arm or leg in a manner similar to a water wing or thigh holster, respectively, and store a single skate.

Figure 4:
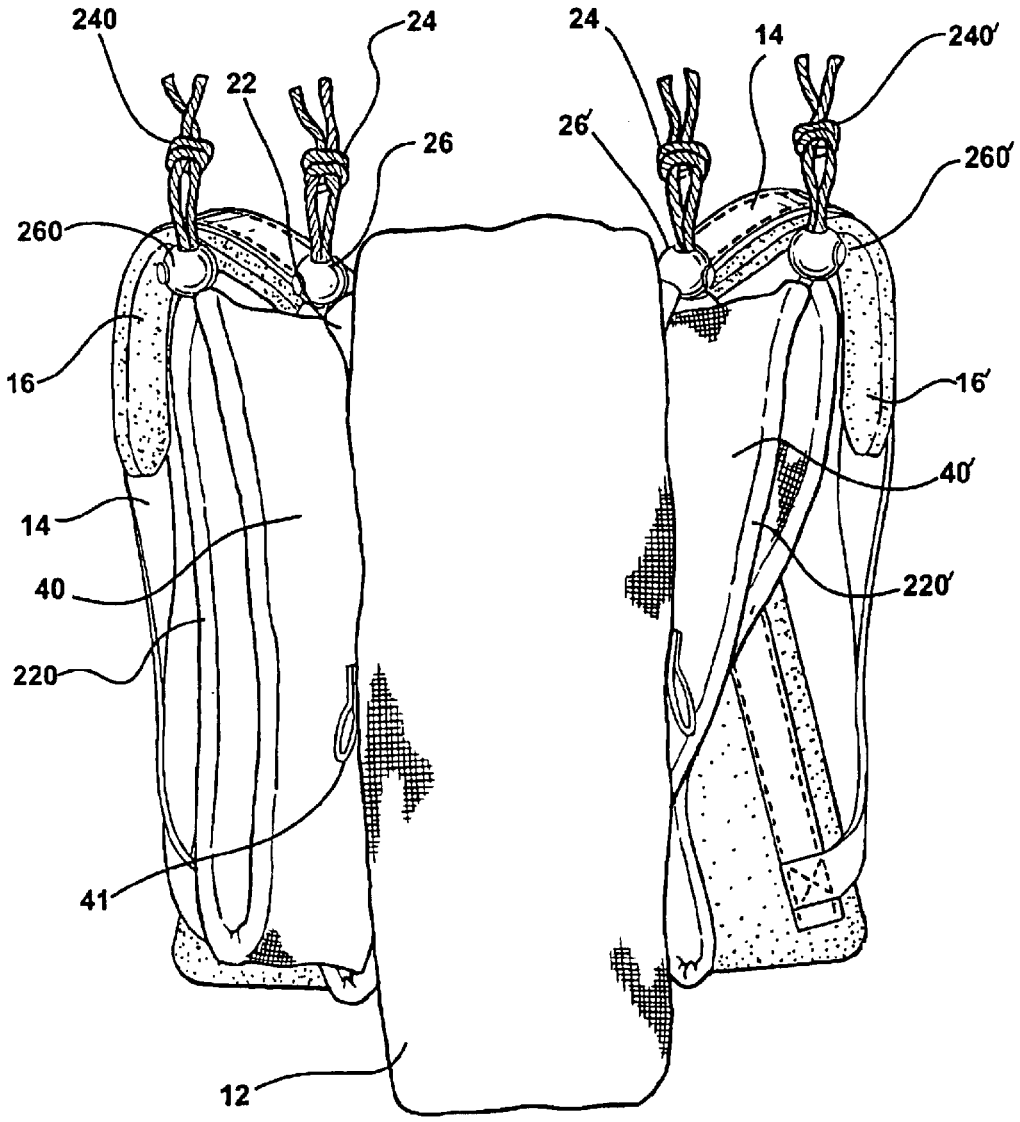
FIG. 4 is a rear view of the pack as shown in FIG. 1 with one extractable shoe cover fully extracted (40) from the carrier compartment and another extractable shoe cover partially extracted (40')
Figure 5:
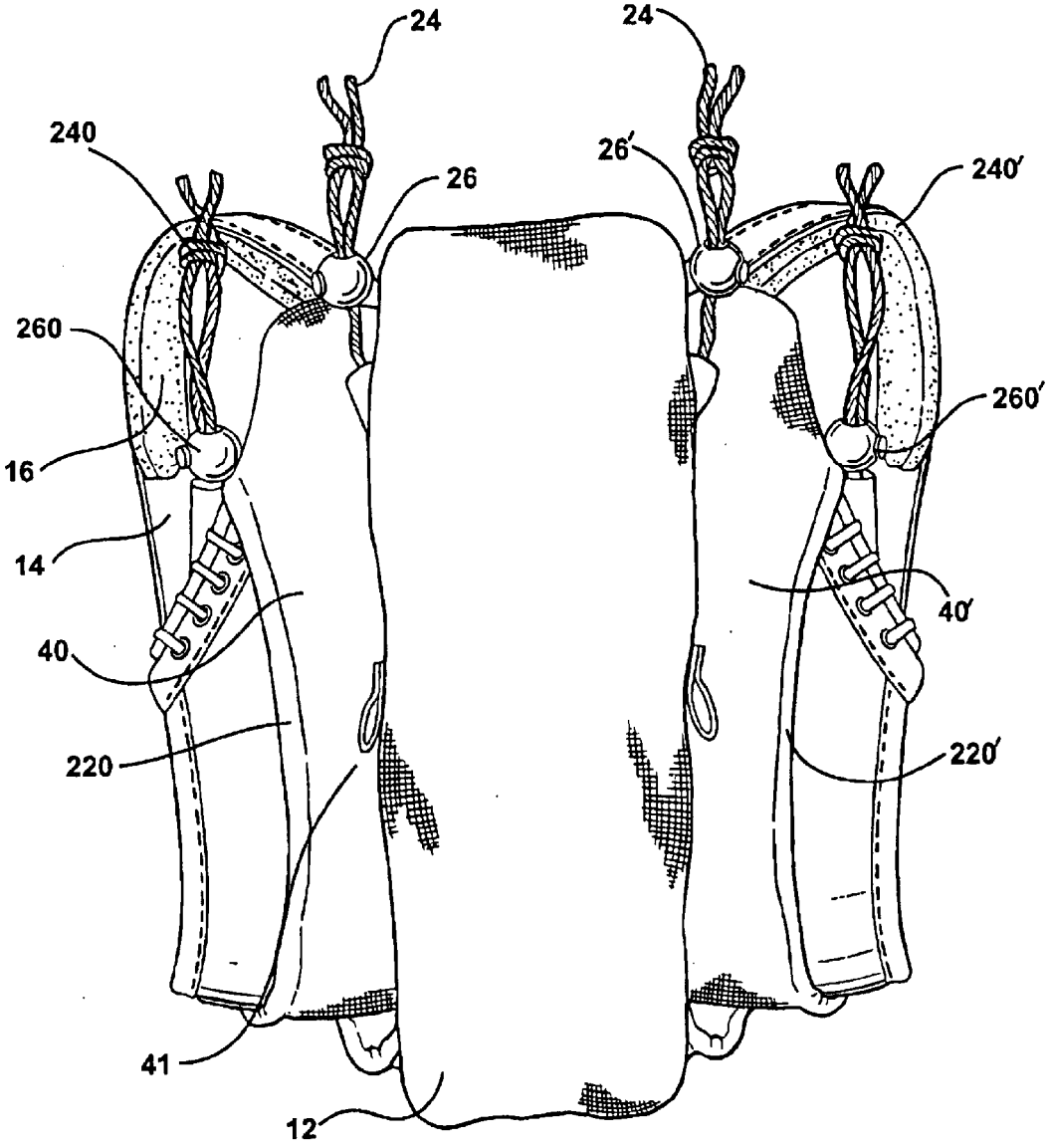
FIG. 5 is a rear view of the pack as shown in FIG. 1 with shoes in the extractable shoe covers.
Figure 6:
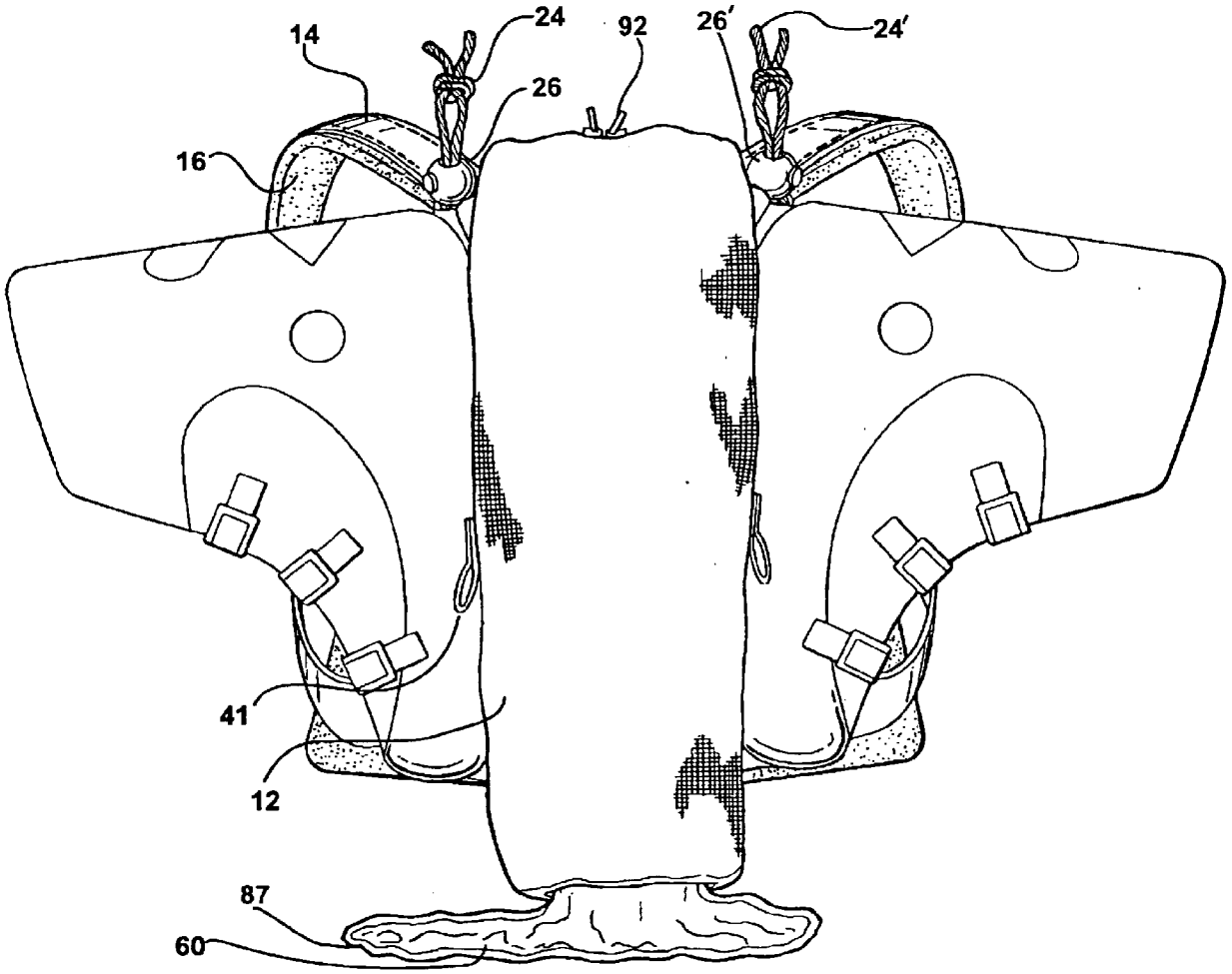
FIG. 6 is a rear view of the pack as shown in FIG. 1 with inline skates in place and with the extractable rain cover partially extracted.
Figure 7:
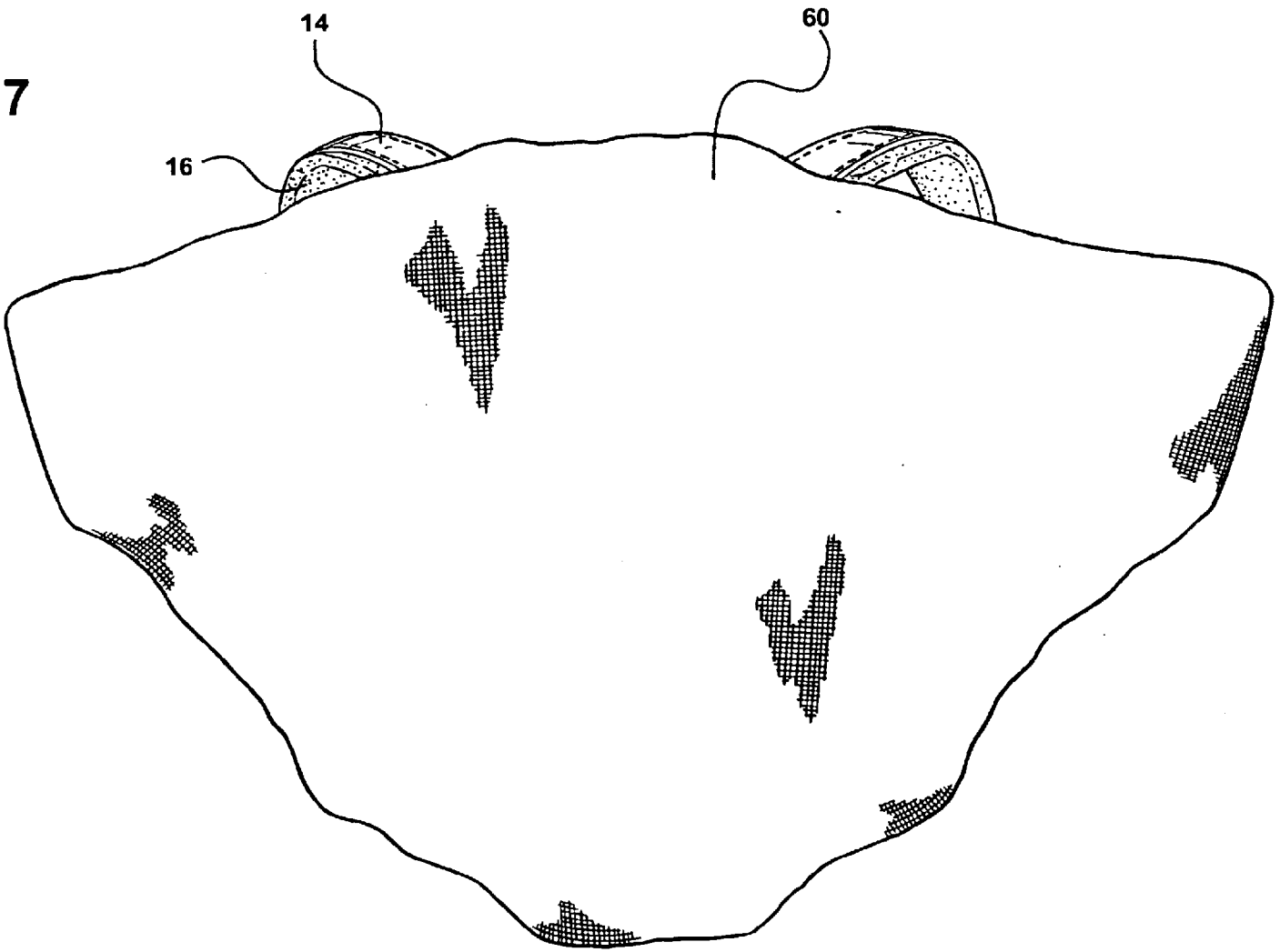
FIG. 7 is a rear view of the pack as shown in FIG. 1 with inline skates in place and with the extractable rain cover fully extracted and covering the skates.
Figure 8:
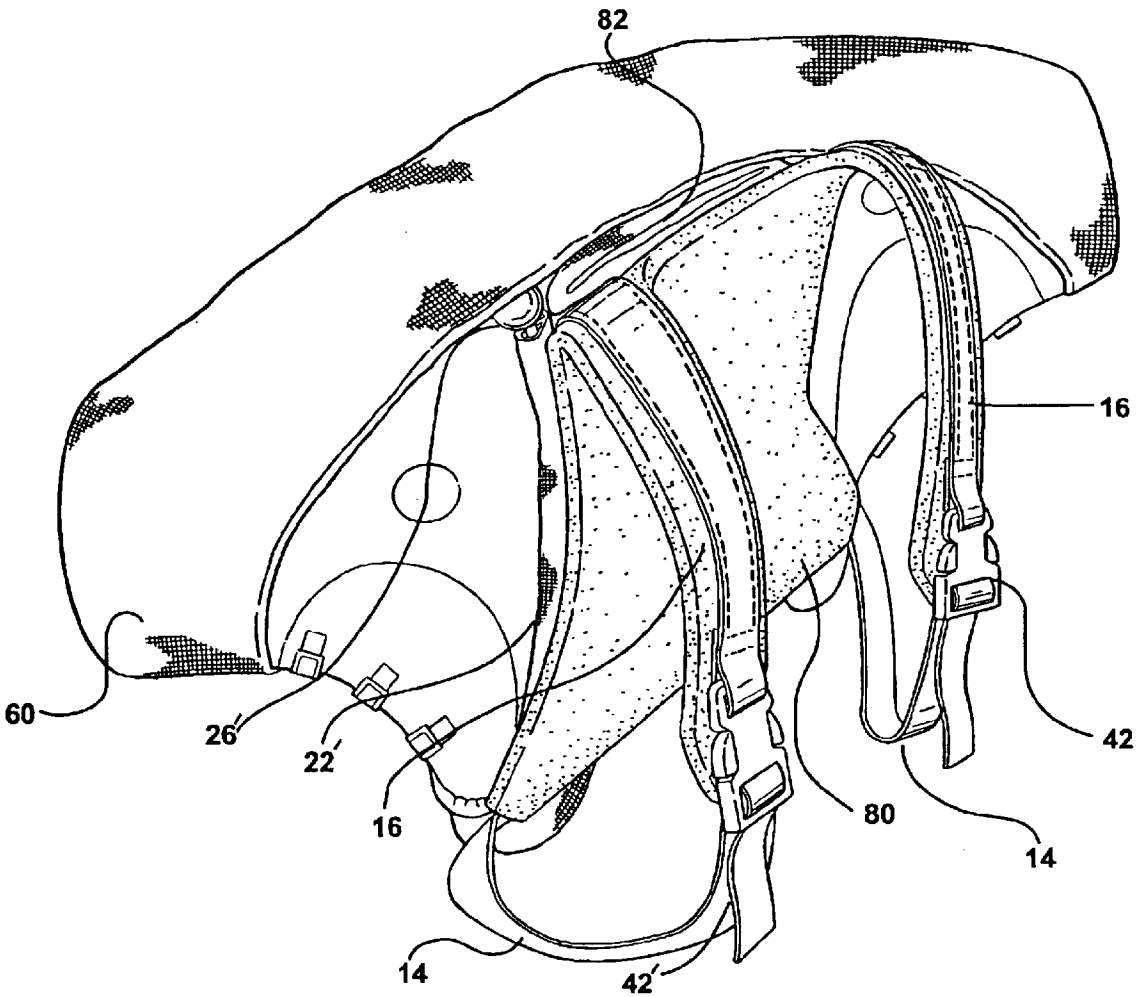
FIG. 8 is a front perspective view of the pack as shown in FIG. 1 with inline skates in place and with the extractable rain cover fully extracted and covering the skates.
Figure 9:
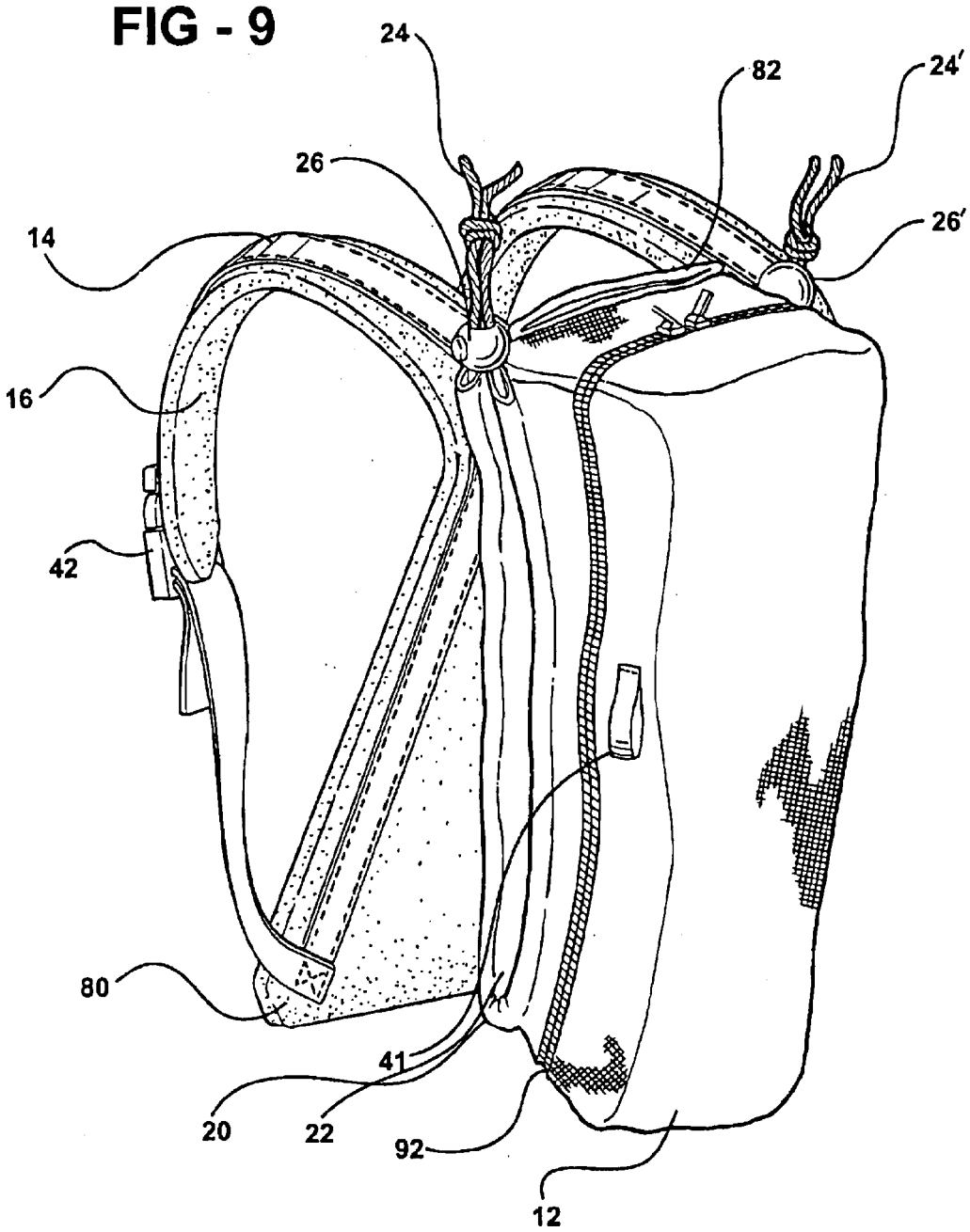
FIG. 9 is a perspective view of the pack as shown in FIG. 1 showing a sack for carrying various articles.
Figure 10:
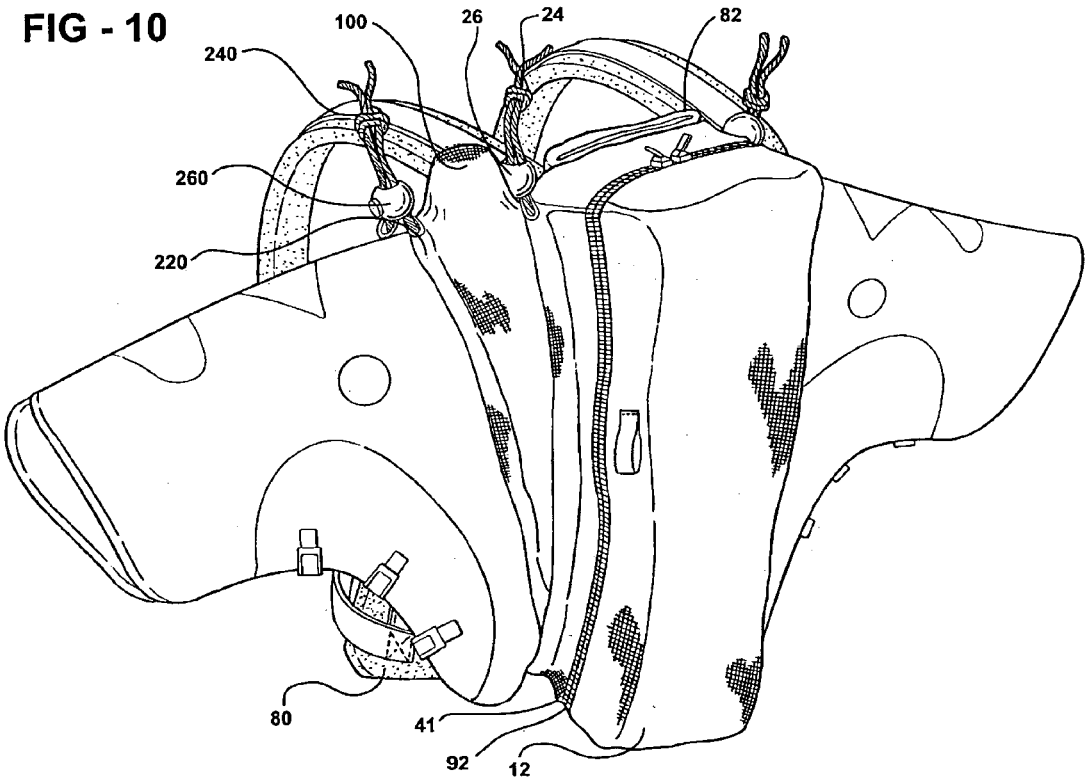
FIG. 10 is a top perspective view of the pack as shown in FIG. 1 with inline skates in place and an expandable brake section partially extracted.
Figure 11:
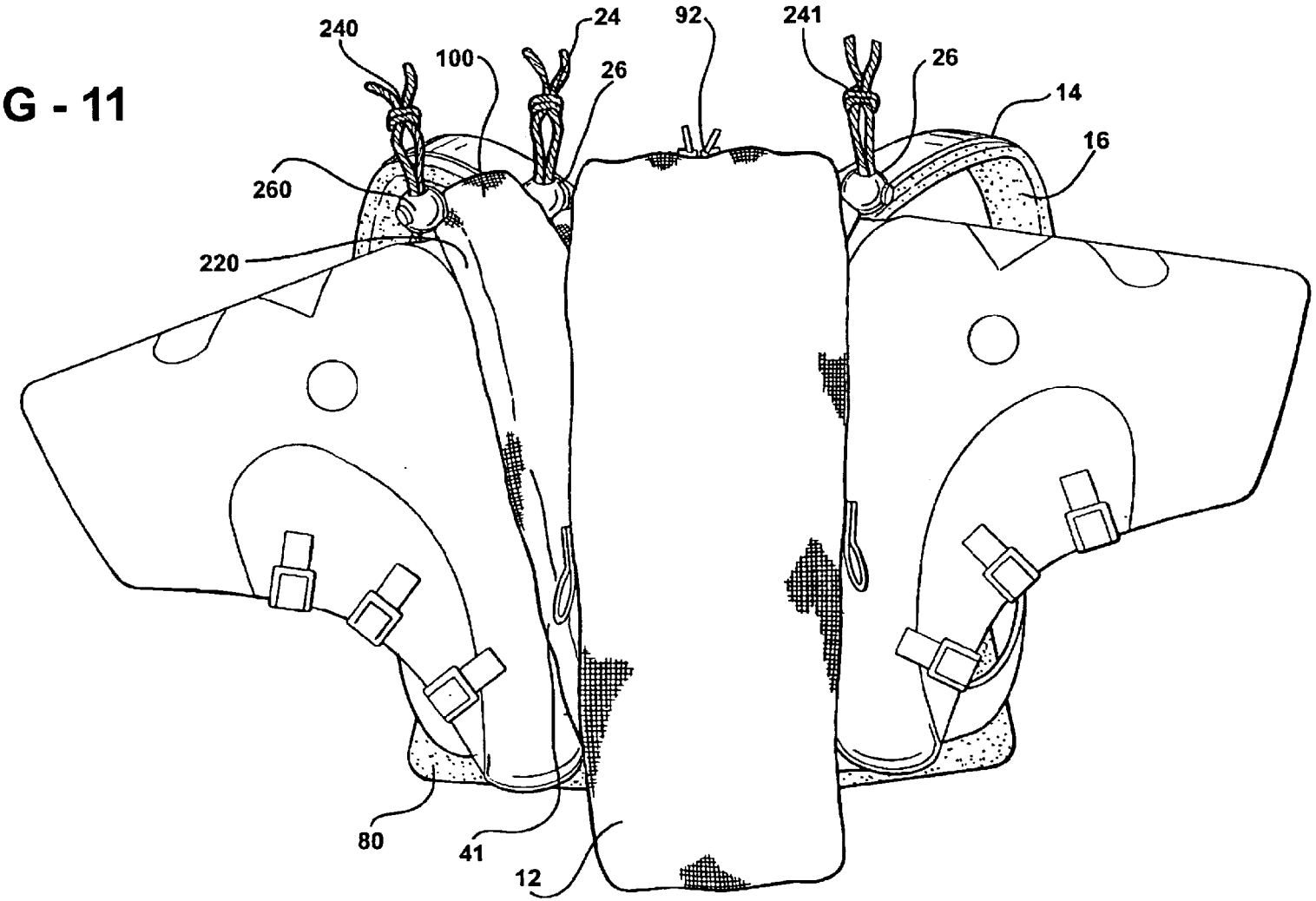
FIG. 11 is a rear view of the pack as shown in FIG. 1 with inline skates in place and an expandable brake section partially extracted.
Figure 12:
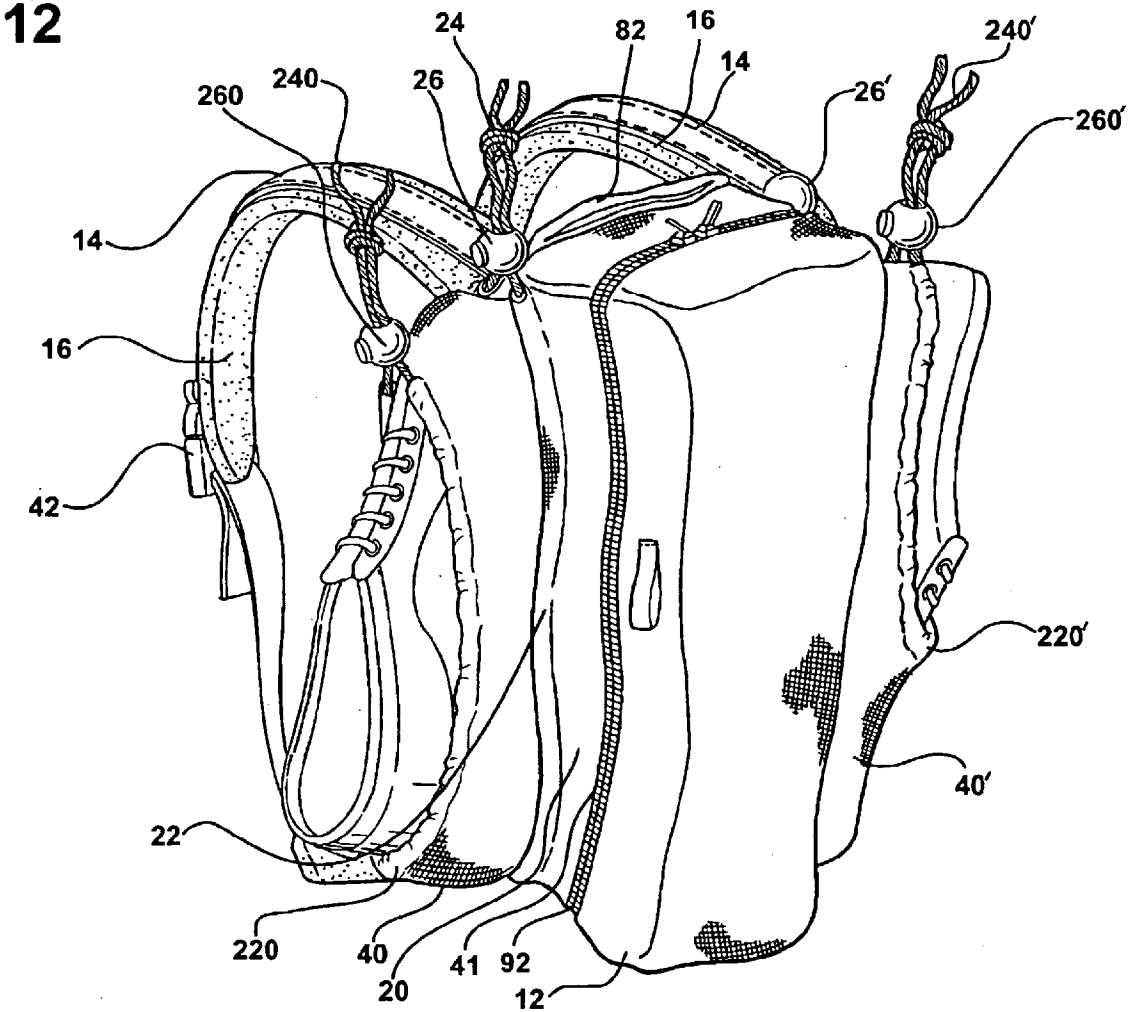
FIG. 12 is a top perspective view of the pack as shown in FIG. 1 with shoes in place.

Referring to FIGS. 1–13, according to the invention a pack shown generally at 10 is provided for carrying footwear where like numerals among drawings correspond to like elements. The pack 10 has a pair of skate blade compartments 20 and 20'. Each skate blade compartment optionally includes an extractable shoe cover 40 and 40' adapted for securing other footwear as shown in FIGS. 4 and 5. The pack 10 also optionally includes a sack 12 for carrying personal and sports-related items. A hang loop 41 is optionally attached to the sack 12. An extractable rain fly 60 is optionally provided as shown in FIGS. 2 and 6–8. An expandable skate brake section 100 is also optionally provided as shown in FIG. 10. The pack 10 further optionally includes a semi-rigid or rigid back support 80 attached to the skate blade compartment 20. A strap 14 is provided for carrying the pack. Optionally, the strap 14 has padding 16 to provide comfort during use. The strap 14 has an optional adjuster 42 for changing strap length.

The pack 10 includes a skate blade compartments 20 and 20'. While the skate blade compartment 20 is described hereafter, primed numerals denote like structures of the second skate compartment 20'. The compartment 20 has a wall 21. The skate blade compartment wall 21 has a first opening 18. The opening 18 is adapted to receive a skate blade. The skate blade compartment 20 is sized to accommodate the blade portion of a skate S. In a preferred embodiment, the blade portion of each skate is inserted into the skate blade compartment 20 and 20' in an opposable wing manner such that one skate is carried on the right side of the backpack and one skate is carried on the left side of the backpack. It is appreciated that other skate orientation such as horizontal or diagonal blade lines are also operative herein. A skate blade compartment 20 is made from a light, flexible material such as nylon and other suitable synthetic or natural materials illustratively including PVC, polyester and cotton. Once the skate blade B is inserted in the skate blade compartment 20, the blade is secured and held in place by a securing element. A securing element is preferably a zip cord 24 with a cord lock 26 as depicted in FIGS. 1–13. The zip cord 24 is tightened around the skate blade B and locked, securing the skate blade B in the skate blade compartment 20. The boot part of the skate A remains outside the skate blade compartment 20. The cinch cord 24 is located in a cord casing 22. A cord casing is located at the outermost edge of the first opening 18 in the skate compartment wall 21.

An optional feature of the present invention is an expandable brake section 100 of the skate blade compartment 20. In a preferred embodiment, the expandable brake section 100 is a part of the skate blade compartment 20 folded into itself. In order to accommodate one or more skates with brakes, the top of the skate blade compartment is extracted from its collapsed conformation in the interior of the skate blade compartment 20 to make room for the skate brake B. When not in use, the expandable brake section 100 is folded into the skate blade compartment 20 and retained in a retracted position with a hook and loop fastener 84. Alternatively, the brake section 100 is retained within the compartment 20 by a zipper (not shown).

Figure 1:
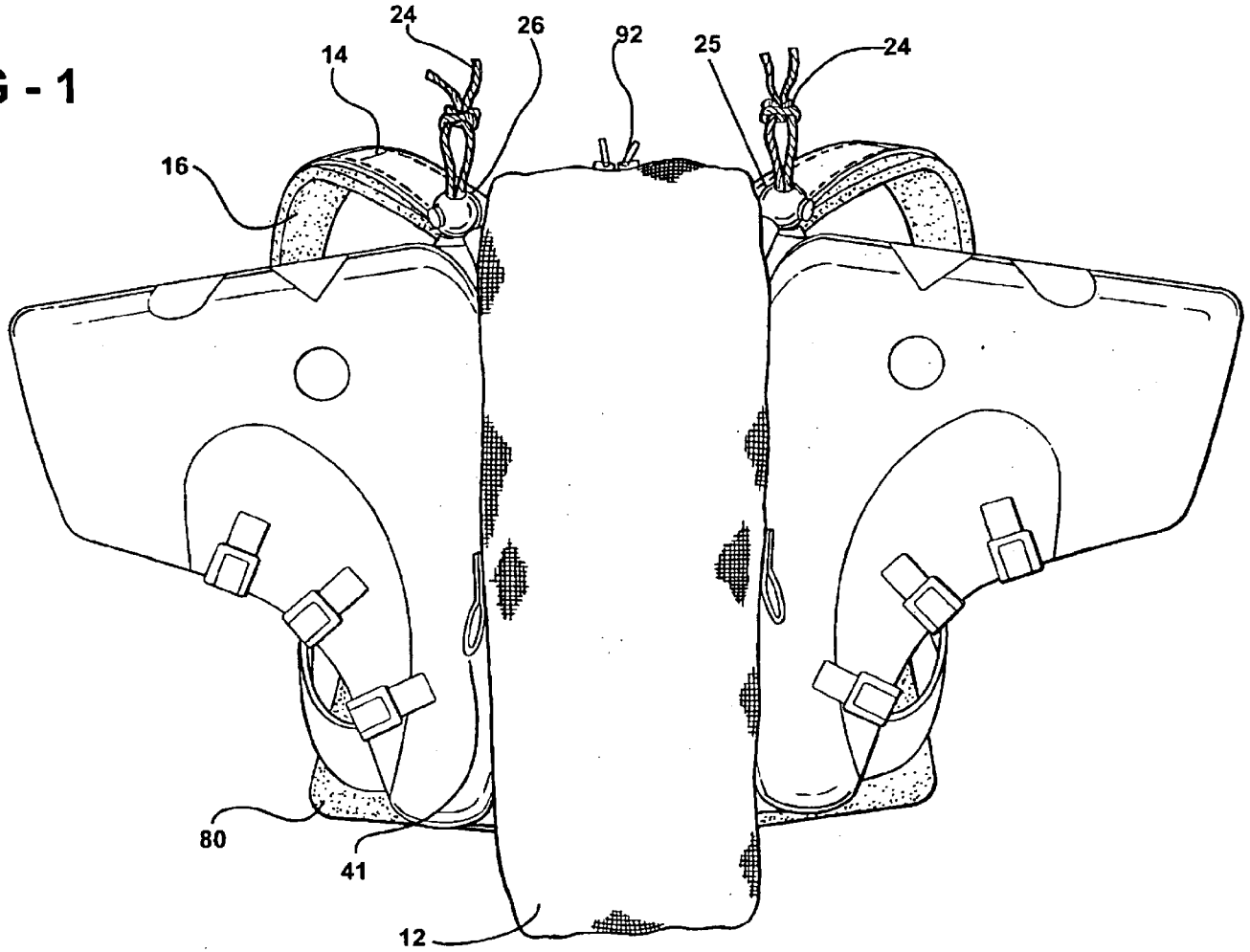
FIG. 1 is a rear view of a backpack according to the invention.
Figure 2:
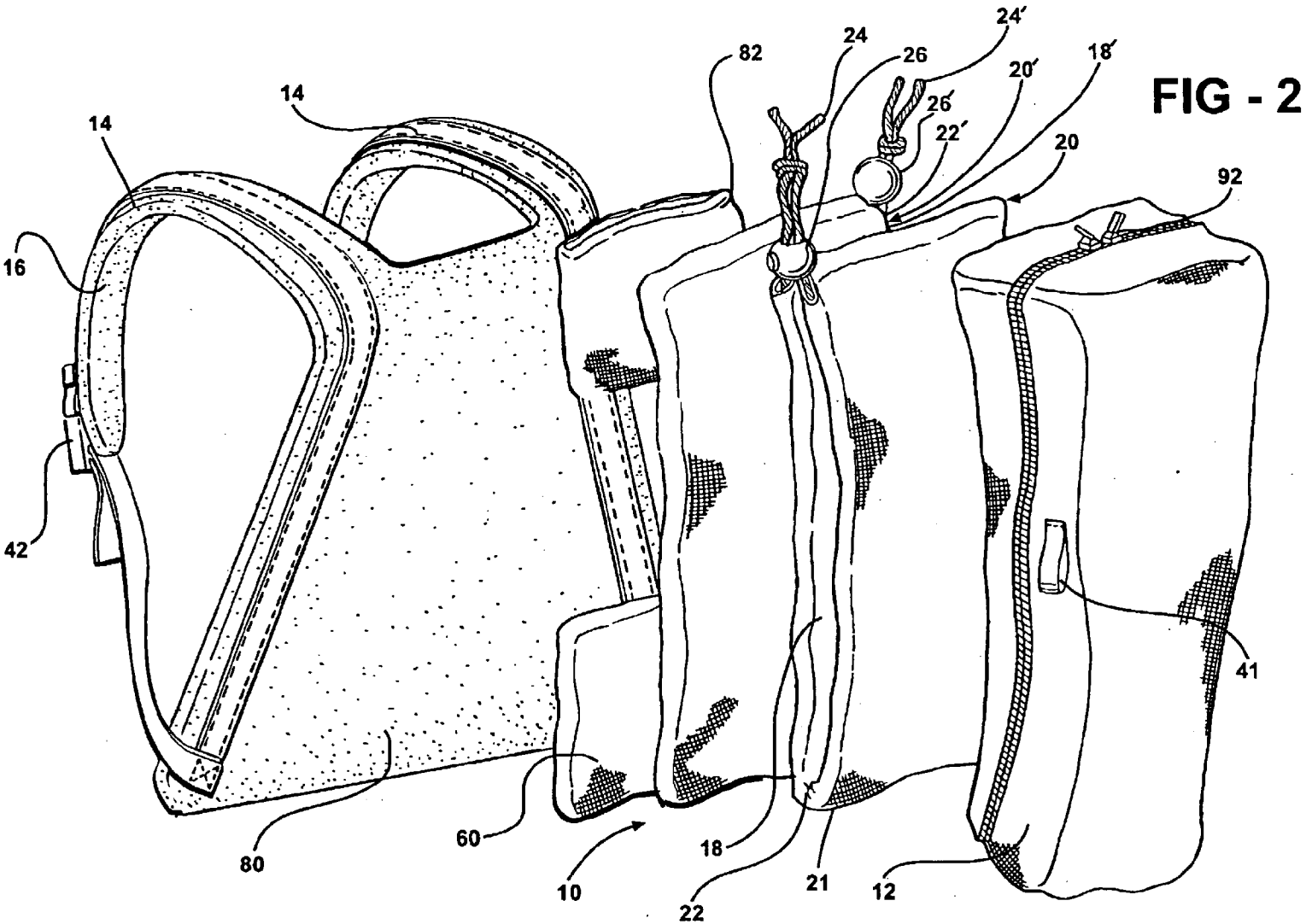
FIG. 2 is an exploded perspective view of the pack as shown in FIG. 1.
Figure 3:
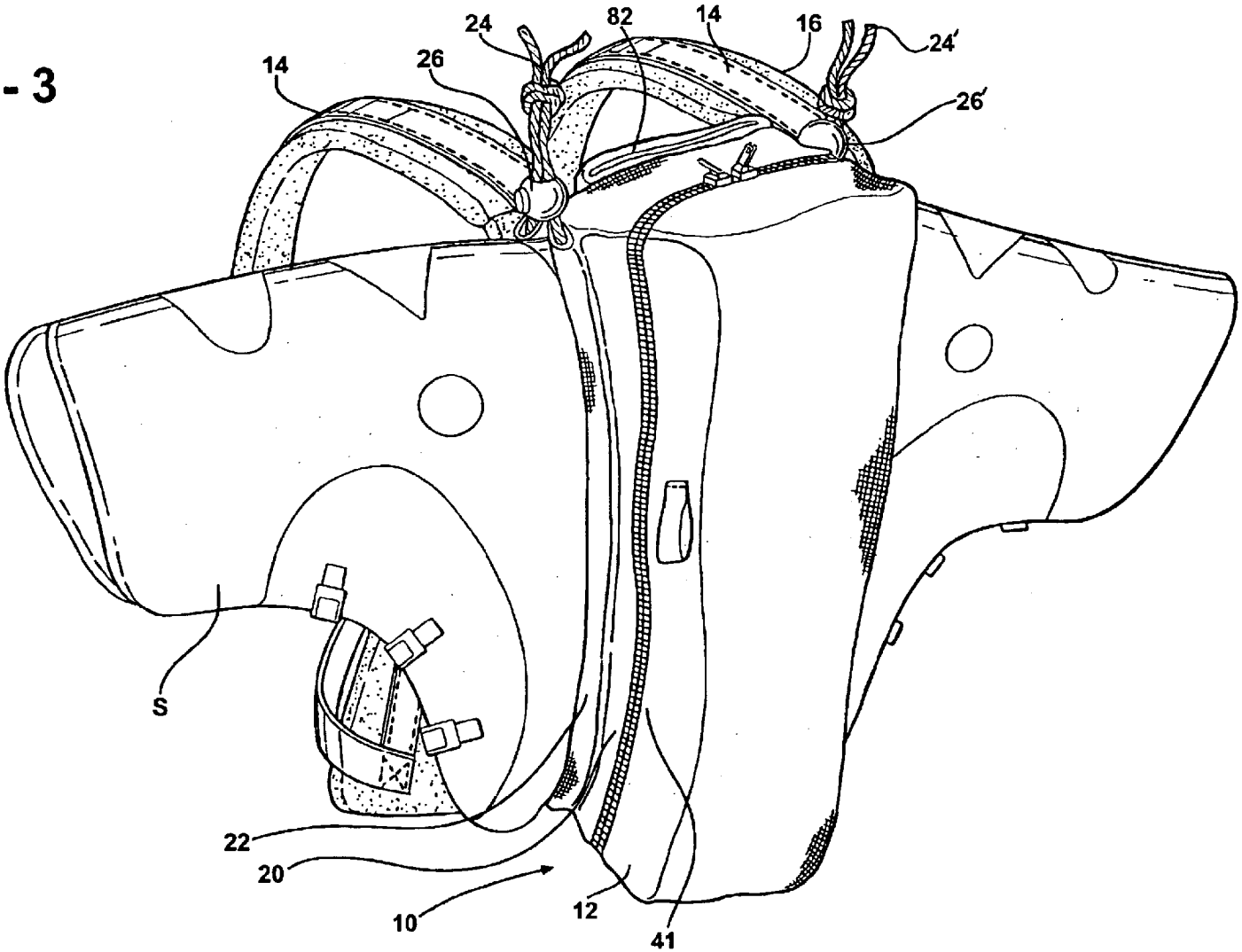
FIG. 3 is a magnified perspective view of the pack as shown in FIG. 1.
Figure 13:
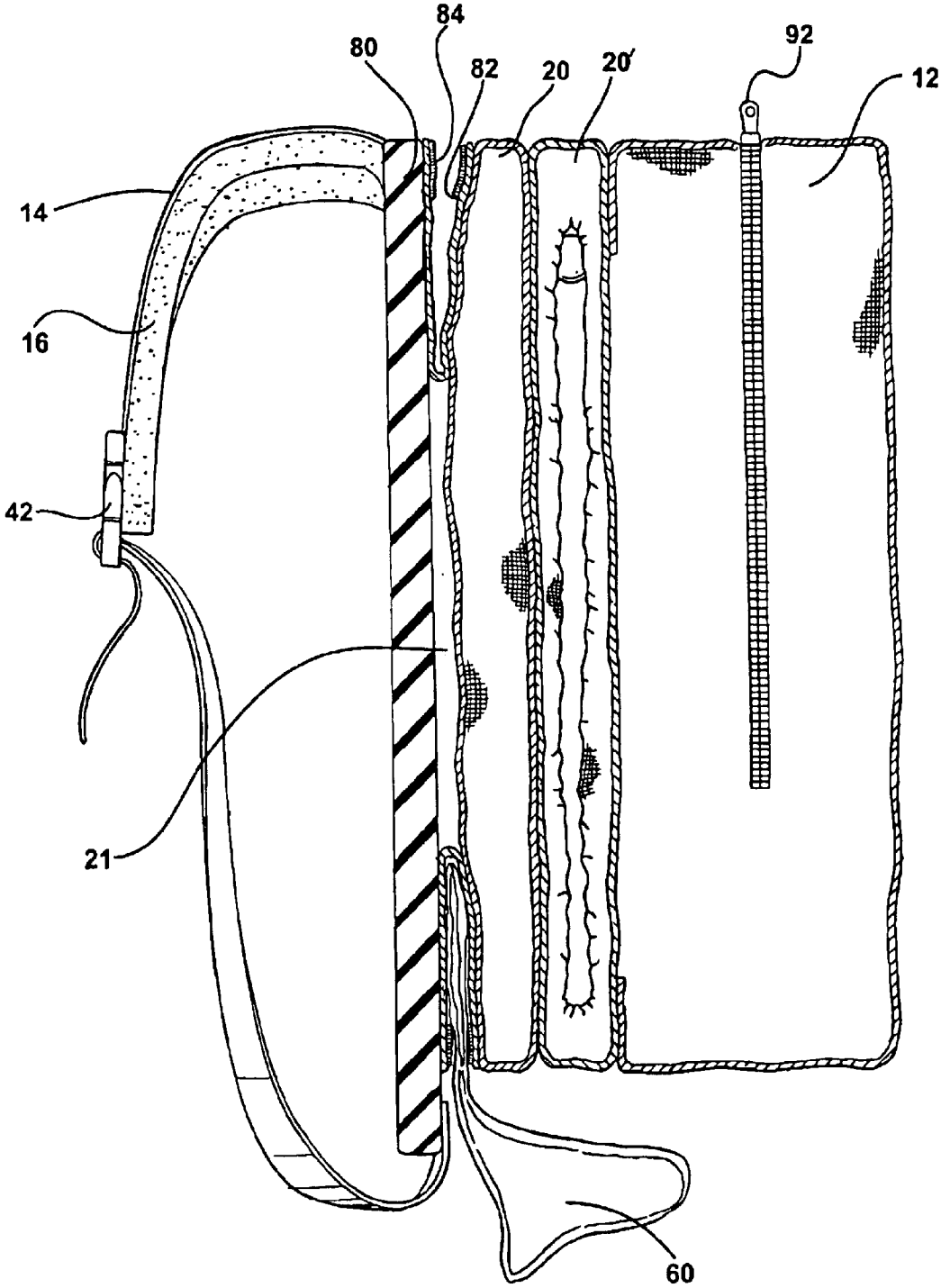
FIG. 13 is a partial cutaway side view of the pack as shown in FIG. 1.

The wall 21 of the skate blade compartment 20 is attached to a back support 80. In a preferred embodiment, intermediate between the wall 21 and the back support 80 are a pouch 82 and the extractable rain fly pouch 60 as shown in FIGS. 2 and 13. The pouch 82 affords additional storage space for personal effects. As shown in FIG. 13, the pouch 82 is selectively closed by way of a hook and loop fastener 84. It is appreciated that the size and shape of the pouch 82 is readily modified. Additionally, the hook and loop fastener 84 depicted in FIG. 13 is readily replaced by any conventional selective fabric fastener illustratively including snaps, a zipper, hook and cord, and zip cord. It is further appreciated that the pouch 82 is readily configured to receive specific objects such as a small electronic device illustratively including a PDA, cellular telephone, or laptop computer.

Optionally, either the pouch 82 and/or the sack 12 has additional securement fasteners either interior or exterior to the pouch 82 or sack 12. Securement fasteners operative herein illustratively include a key clip, a pocket, an elastic strap, netting or the like. Such securement fasteners have utility in selectively securing personal articles, and in particular bulky articles, to the exterior of an inventive pack. For example, personal articles such as a jacket or a beverage container are readily coupled with the inventive pack.

The pack 10 optionally includes an extractable shoe cover 40. The shoe cover 40 is continuous with the skate blade compartment 20. When extracted, a shoe is placed in the shoe cover 40 such that a shoe is partially enclosed therein. The shoe is secured in place by the shoe securing element. The securing element is preferably the zip cord 240 with a cord lock 260. The zip cord 240 is tightened around the shoe, securing it in the shoe cover 40. The zip cord 240 is located in a cord casing 220. When not in use, the shoe cover 40 is lodged within the skate blade compartment 20.

In an alternate embodiment, each of the skate compartments shown in FIGS. 1–13 at 20 and 20' are coupled together and in turn to a back support with a conventional fastener system illustratively including snaps, clips, hook and loop, and similar types of fasteners alone or in combination such that the inventive pack is readily separated into component parts in order to afford additional storage and transportation options for the present invention. It is appreciated that handle straps are incorporated into the construction of any component parts depicted in FIG. 2 to afford additional transport options. For example, the skate compartments in a modular design are readily removable and the sack 12 attached to the back support to afford a conventional backpack structure.

The backpack 10 optionally includes a sack 12 for carrying personal and sports-related items. The sack 12 is attached to the outermost skate blade compartment 20'. The sack 12 is preferably rectangularly shaped and includes a zipper closure 92. The sack 12 may take other shapes illustratively including oblong and pyramidal. Other closure devices may be used illustratively including snaps and hook-loop fasteners.

The backpack 10 optionally includes a rain fly 60 for protecting shoes, skates and personal items from rain, snow, mud and the like. The fly 60 is sized to encompass the sack and skates or shoes. The fly 60 is snugged around the sack and skates or shoes by means of an elasticized element 87 incorporated into the outermost edge of the fly. Alternatively, the fly 60 may be adjusted by a zip cord with a cord lock. In a zip cord embodiment, the zip cord is located in a cord enclosure at the outermost edge of the cover 60. When not in use the fly 60 is stored in a backpack space. In a preferred embodiment, the fly 60 is stored in the skate blade compartment 20. Other spaces where a fly is stored when not in use illustratively include a space between the sack 12 and the skate blade compartment 20, and a space between the back support 80 and the skate blade compartment 20. Optionally, a closable fly compartment is provided. The closable fly compartment is located in the sack 12, skate blade compartment 20 or back support 80. The fly is optionally attached to an element of the backpack illustratively including the back support 80 and the sack 12.

In another embodiment, the present invention provides a retrofit skate blade compartment for use with a conventional backpack. The retrofit skate blade compartment has a wall with two parallel openings adapted to receive skate blades, each opening having a securing element which is preferably a zip cord with a cord lock. The zip cord is tightened around the skate blade and locked, securing it in the skate blade compartment. The retrofit skate blade compartment is attachable to a conventional backpack to allow a user to carry bulky footwear. The retrofit skate blade compartment has a fastener to allow attachment to a conventional backpack. The fastener illustratively includes hook-loop fasteners, ties and snaps.

Modifications to the elements and the relationship therebetween of the inventive pack will be readily apparent to one skilled in the art upon reading the above specification without departing from the spirit thereof. It is intended that such modifications and equivalents thereof fall within the scope of the appended claims.

What is claimed is:

1. A pack comprising:

a skate blade compartment having a first adjustably sized opening defined by a first wall and adapted to receive a first skate blade therein;

a second adjustably sized opening defined by a second wall and adapted to receive a second skate blade therein, wherein each of the first and second openings has a securing element and the first skate blade and the second skate blade are maintained in an opposable wing manner;

an extractable shoe cover projects from said skate blade compartment and is continuous with the skate blade compartment to form a shoe cover; and a first carrying strap affixed to said skate blade compartment.

2. The pack of claim 1 further comprising a second strap affixed to said skate blade compartment wherein said first strap and said second strap are spaced along said skate blade compartment.

3. The pack of claim 1 further comprising a sack secured to said skate blade compartment.

4. The pack of claim 1 further comprising a pocket formed adjacent to said skate compartment.

5. The pack of claim 4 further comprising a rain cover extending from the pocket and over at least a portion of said skate compartment.

6. The pack of claim 1 further comprising a hang loop.

7. The pack of claim 1 wherein said skate compartment has an expandable brake section that projects from said skate blade compartment and is continuous with the skate blade compartment.

8. The pack of claim 1 further comprising a back support intermediate between said skate compartment and said strap.

9. The pack of claim 1 further comprising a pad layered onto said strap.

10. The pack of claim 1 wherein the securing element is a zip cord.

11. The pack of claim 1 wherein said first opening and the second opening are parallel.

12. The pack of claim 11 wherein said skate compartment is separable into a first portion and a second portion, said first portion including the first opening and said second portion including the second opening.

13. A pack comprising:

a skate blade compartment having a first adjustably sized opening defined by a first wall and adapted to receive a first skate blade therein parallel to a second adjustably sized opening and adapted to receive a second skate blade therein, wherein each of the first and second openings has a securing element and the first skate blade and the second skate blade are maintained in an opposable wing manner, and said skate compartment has an expandable brake section that projects from said skate blade compartment and is continuous with the skate blade compartment; and a pair of straps spaced along said skate blade compartment, said pair of straps adapted to engage a user shoulders.

14. The pack of claim 13 wherein an extractable shoe cover projects from said skate blade compartment and is continuous with the skate blade compartment to form a shoe cover.

15. The pack of claim 13 further comprising a sack secured to said skate blade compartment.

16. The pack of claim 13 further comprising a pocket formed adjacent to said skate blade compartment.

17. The pack of claim 13 further comprising a hang loop.

18. The pack of claim 13 further comprising a back support intermediate between said skate blade compartment and said strap.

19. The pack of claim 13 further comprising a pad layered onto said pair of straps.

20. The pack of claim 13 wherein the securing element is a zip cord.

21. The pack of claim 20 wherein said skate blade compartment is separable into a first portion and a second portion, said first portion including the first opening and said second portion including the second opening.

* * * * *

UNITED STATES PATENT AND TRADEMARK OFFICE

CERTIFICATE OF CORRECTION

PATENT NO. : 6,786,375 B2
DATED : September 7, 2004
INVENTOR(S) : Morris Elijah Worden IV et al.

It is certified that error appears in the above-identified patent and that said Letters Patent is hereby corrected as shown below:

Title page,
Item [75], Inventor, replace "Eli Worden" with, -- Morris Elijah Worden IV --.

Signed and Sealed this

Twenty-second Day of March, 2005

JON W. DUDAS
*Director of the United States Patent and Trademark Office*